10/15/99 09 4,546,508

United States Patent [19]

Ison

[11] Patent Number: 4,546,508

[45] Date of Patent: Oct. 15, 1985

[54] BEDDING ASSEMBLY

[75] Inventor: Deborah K. Ison, Deer Lodge, Mont.

[73] Assignee: Deserdein, Incorporated, Arlington, Tex.

[21] Appl. No.: 702,439

[22] Filed: Feb. 19, 1985

Related U.S. Application Data

[63] Continuation of Ser. No. 474,163, Mar. 10, 1983, abandoned.

[51] Int. Cl.[4] ..... A47G 9/00

[52] U.S. Cl. ..... 5/494; 5/482; 5/502

[58] Field of Search ..... 5/482, 488, 493, 494, 5/495, 496, 497, 498, 502

[56] References Cited

U.S. PATENT DOCUMENTS

| | | | |
|---|---|---|---|
| D. 160,856 | 11/1950 | Goodstein | 5/493 |
| 1,403,873 | 1/1922 | Scott | 5/494 |
| 1,885,558 | 11/1932 | Smith | 5/494 |
| 2,851,703 | 9/1958 | Greco | 5/494 |
| 3,254,348 | 6/1966 | Addario | 5/497 |
| 3,377,636 | 4/1968 | Addario | 5/497 |
| 3,530,487 | 9/1970 | Beer | 5/494 |
| 3,855,655 | 12/1974 | Propst | 5/488 |
| 4,304,018 | 12/1981 | McClam | 5/485 |
| 4,413,368 | 11/1983 | Schuetze | 5/494 |

*Primary Examiner*—Gary L. Smith
*Assistant Examiner*—Vinh Luong
*Attorney, Agent, or Firm*—Kanz, Scherback & Timmons

[57] ABSTRACT

A bedding assembly including a base encompassing portion, a base covering portion and a body covering portion; the base encompassing portion including a peripheral section around the periphery of a base, the peripheral section extending between the top and bottom surfaces of the base, at least one connecting section extending over the bottom surface of the base and permanently joining opposite lower edges of the peripheral section; the base covering portion including a first sheet disposed over substantially the entire top surface of the base and in contact therewith, a first fastener releasably securing the edges of the first sheet to the upper edges of the peripheral section along substantially the entire length thereof; the body covering portion including a second sheet disposed over the first sheet and in contact therewith, the second sheet including at least one pleat extending substantially parallel to the longitudinal axis of the base intermediate and parallel to the edges thereof, a second fastener releasably securing the side edges of the second sheet to adjacent edges of the first sheet, a blanket disposed over the second sheet and in contact therewith, the blanket including at least one pleat disposed substantially parallel to the second sheet pleat, a third fastener releasably securing the side edges of the blanket to adjacent edges of the second sheet, a fourth fastener permanently affixing together the lower transverse edges of the first sheet, the second sheet and the blanket.

14 Claims, 5 Drawing Figures

BEDDING ASSEMBLY

This application is a continuation of application Ser. No. 474,163, filed Mar. 10, 1983 now abandoned.

This invention relates to novel bedding and more particularly relates to a new bedding assembly.

In primitive societies, people sleep very simply. They may sleep in their clothes on the ground or on a thin pad or mattress and cover their bodies with a blanket.

In more developed societies, people have become accustomed to sleeping in night clothes on a bed with a mattress and a spring. The mattress is covered with some type of bedding. Ordinarily, this bedding includes a bottom sheet spread over the mattress and a top sheet which covers the body. A blanket or quilt is placed over the top sheet for warmth.

This bedding combination has been used for centuries. Very few changes have been made through the years. One of the innovations in bedding is the fitted sheet. Fitted sheets assist in maintaining a smooth surface without having to tuck the edges of the sheet under the mattress each day.

Although fitted sheets have become quite popular, they only solve some of the problems inherent with conventional bedding. While bottom sheets can be fitted over the entire surface of a mattress, top sheets and blankets are fitted only along the bottom edges. The side and top edges must be free to permit access of a person's body between the sheets.

The loose fit of the top sheet and blanket allows these items to become displaced during a night of sleep. Although a few individuals sleep without any significant rolling or twisting, most persons twist and turn a great deal while they are sleeping. This twisting and turning causes the sheet and blanket to shift and become twisted into a tangled mass that does not cover a sleeper's body. If the sleeping person becomes sufficiently chilled he ordinarily will awaken and straighten the covers over him again. However, some persons such as children and the elderly may not awaken and thus become chilled to such an extent that their health suffers.

Even if the individual does not throw off the covers as he sleeps, when he awakens in the morning, the twisted sheet and blanket still may be present. The bedding then must be remade again. Under ideal conditions, remaking the bedding requires moving around the bed several times to straighten and tuck the edges of the top sheet and blanket in place.

If the bed is small in size, the bedding can be straightened in a few minutes if there is good access around the bed. However, if the bed is large, such as a king size bed, or if the bed is in a relatively inaccessible location such as in a mobile home or recreational vehicle, remaking the bedding may take considerable time and effort. It may be necessary to climb over the bed several times to achieve even a limited degree of smoothness.

While a dedicated homemaker may consider the remaking of the bedding a task which is a worthwhile use of her time, most people regard bed remaking a necessary evil. Some persons such as most men and youngsters consider bedding making to be a worthless expenditure of their effort and time.

When individuals have this negative attitude about remaking the bedding, the results are less than satisfactory. Some persons simply skip the remaking and just straighten the covers to a degree.

Even if daily bedding remaking is skipped or minimized, there still remains the changing of the bedding as an additional major task. The bottom sheet, the top sheet and the blanket or quilt must be removed from the bed and replaced again. There is no way of avoiding this task.

In some situations proper bedding making still is mandatory. Hospitals, boarding schools and other semipublic sleeping facilities require good bedding making to avoid complete deterioration of housekeeping standards. These situations, however, are the most prone to have problems in achieving good bedding making.

Bedding making in hospitals involves the additional problem of doing the task while a person is lying in the bed. This greatly complicates the task and ordinarily requires special training. With boarding schools, the resistance of the students to any chore creates difficulties and only the general strict discipline of the school enables the required standards to be met.

From the above discussion, it is clear that past and present bedding leaves much to be desired. Thus, there is a need for new bedding that can overcome the deficiencies of previous bedding.

The present invention provides a novel bedding assembly which substantially eliminates the problems with conventional bedding. The bedding assembly of the invention provides a simple and convenient means for making a bed. The bedding assembly permits a person to make bedding in a minute or two. The bedding assembly enables an individual to make the bedding easily and quickly even on larger beds and beds that are in confined locations.

The bedding assembly of the invention can be used efficiently by persons of all ages from the young to the elderly. High quality results can be achieved by individuals with minimum motivation for the task. The bedding assembly is especially useful for hospitals since it greatly simplifies the making of the bedding when a person is in the bed.

The bedding assembly of the present invention is simple in design and can be produced relatively inexpensively. Commercially available materials and components can be utilized in the fabrication of the bedding assembly. Conventional sewing and fabric construction techniques and procedures and semi-skilled labor can be employed in the manufacture of the bedding assembly.

The bedding assembly of the invention is durable in construction and has a long useful life even with repeated laundering and use. Few, if any, repairs are required to maintain the bedding assembly in good useable condition.

These and other benefits and advantages of the novel bedding assembly of the present invention will be apparent from the following description and the accompanying drawings in which.

Figure 1:
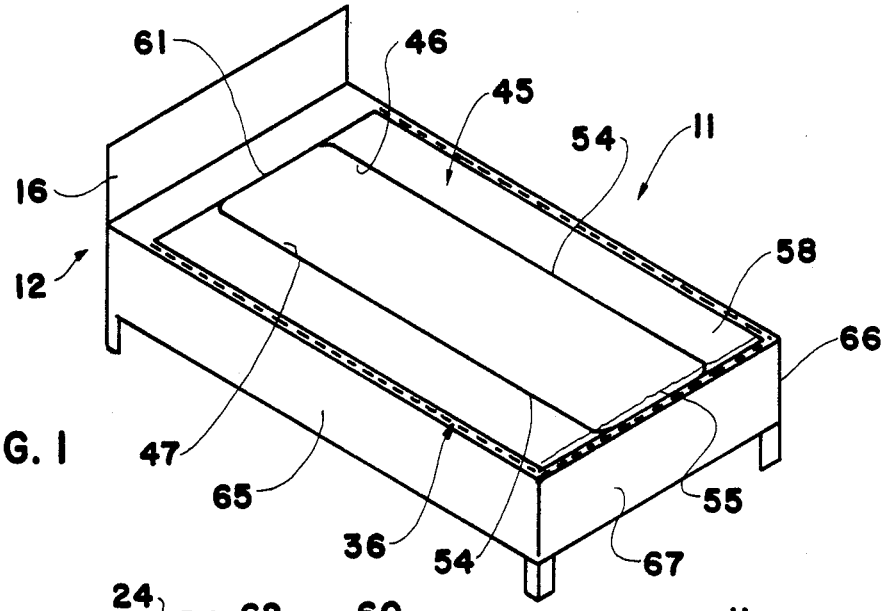
FIG. 1 is a view in perspective of one form of the bedding assembly of the invention disposed on a bed.
Figure 2:
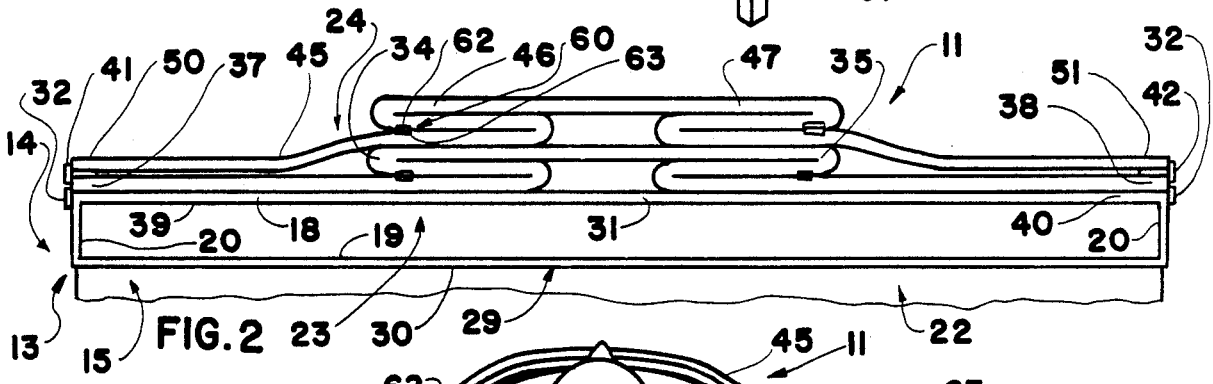
FIG. 2 is a sectional view of the bedding assembly shown in FIG. 1 taken along line 2—2 thereof.

As shown in the drawings, one form of the novel bedding assembly 11 of the present invention is positioned on a bed 12 including a base 13 that includes a mattress 14 resting on a spring 15 and a frame 16. The mattress 14 includes major top and bottom surfaces 18 and 19 respectively. Also, the mattress includes peripheral sidewall sections 20 joining the major surfaces 18 and 19 thereof.

The bedding assembly 11 includes a base encompassing portion 22, a base covering portion 23 and a body covering portion 24. The base encompassing portion 22 of the bedding assembly 11 of the invention includes a peripheral section 26 around the periphery of the base 13.

The peripheral section 26 extends between the top and bottom surfaces 18 and 19 of the mattress 14. The peripheral section 26 further includes an upper edge 27 adjacent the top surface 18 and a lower edge 28 adjacent the bottom surface 19. Advantageously, the peripheral section 26 includes a continuous section that circumscribes the periphery of the base 13.

The base encompassing portion 22 also includes at least one connecting section 29. The connecting section 29 extends over the bottom surface 19 of the mattress 14. The connecting section 29 permanently joins opposite lower edges of the peripheral section 26. The connecting section 29 preferably includes sheet means 30 as shown that substantially covers the bottom surface 19.

The base covering portion 23 of the bedding assembly 11 of the invention includes sheet means 31. The sheet means 31 is disposed over substantially the entire top surface 18 of the mattress 14 and is in contact therewith. Fastening means shown as zipper 32 releasably secures the edges of the sheet 31 to the upper edges 27 of the peripheral section 26. This connection is along substantially the entire length of the peripheral section 33.

The body covering portion 24 of the bedding assembly 11 includes sheet means 33. The sheet 33 is disposed over the sheet 31 and is in contact therewith. The sheet 33 includes at least one pleat means 34 and advantageously more than one pleat 34 and 35. The spaced pleats 34 and 35 extend substantially parallel to the longitudinal axis of the mattress 14, that is, from the head to the foot of the mattress. The pleats are disposed intermediate and parallel to the side edges of the sheet 33.

Fastening means 36 releasably secures the side edges 37 and 38 of the sheet 33 to the adjacent edges 39 and 40 of the sheet 31. The fastening means 36 preferably includes a pair of edge zippers 41 and 42.

Blanket means 45 is disposed over the sheet 33 and is in contact therewith. The blanket means 45 is similar in construction to the sheet 33 and includes at least one pleat means 46 and advantageously more than one pleat 46 and 47. The spaced blanket pleats 46 and 47 extend substantially parallel to the pleats 34 and 35 of the sheet 33.

Fastening means 48 releasably secures the side edges 50 and 51 of the blanket 45 to adjacent edges 37 and 38 of the sheet 33. The fastening means 48 preferably includes spaced discrete elements that include cooperating combinations of hooked fabric means 52 and napped fabric means 53.

The pleats 34 and 35 of the sheet 33 and the pleats 46 and 47 of the blanket 45 advantageously each are spaced from one another as shown in the drawings. Preferably, the pleats 34/35 and 46/47 of each pair are reversed from one another. Decorative stripping such as piping 54 may be disposed over the pleats to facilitate smoothing thereof, if desired.

Fastening means 55 permanently affixes together the lower transverse edges 56, 57 and 58 of the sheet 31, the sheet 33 and the blanket 45, respectively. The fastening means 55 advantageously includes stitching.

Fastening means 60 preferably are disposed between the free ends 61 of the pleats 34/35 of the sheet 33 and the pleats 46/47 of the blanket 45. Preferably, the fastening means 60 includes cooperating combinations of hooked fabric elements 62 and napped fabric elements 63.

The bedding assembly 11 advantageously also includes skirt sections 65, 66 and 67. These skirt sections extend from the side edges 50 and 51 of the blanket 45 as well as the lower transverse edge 58 thereof. The skirt sections 65–67 advantageously are releasably secured to the edges of the blanket 45 through fastening means 68 such as zippers, snaps and the like.

The bedding assembly 11 of the present invention can be fabricated from conventional bedding materials such as sheets and blankets. The fasteners employed can be conventional zippers, hooked and napped fabric elements and similar fasteners that are commercially available. Sewing of components is accomplished in the normal manner.

The fabrication of the bedding assembly 11 of the present invention as shown in the drawings involves the sewing of the peripheral section 26 to the sheet 30 and the sewing of the zipper 32 along the length of the upper edge of the peripheral section. The other part of the zipper 32 then is sewn around the periphery of the sheet 31.

Next, the sheet 33 is aligned with the sheet 31 and the zippers 41 and 42 sewn along the side edges 37 and 38 of the sheet 33 and the adjacent edges 39 and 40 of the sheet 31. Thereafter, blanket 45 is positioned over the sheet 33 and fastener elements 52 and 53 attached along the adjacent side edges 37 and 38 of the sheet 33 and edges 50 and 51 of the blanket 45.

The lower transverse edges 56, 57 and 58 of sheet 31, sheet 33 and blanket 45 then are affixed together with stitching 55. The bedding assembly 11 now is ready for use.

In the placement of the bedding assembly 11 on a bed 12, the peripheral section 26 with sheet 30 affixed thereto is positioned under and around the periphery of the mattress 14. The sheet 30 is in contact with the lower surface 19 of the mattress and the peripheral section 26 is in contact with the mattress sidewalls 20.

With the zipper 32 disposed along the upper edge of the mattress, the combination of sheet 31, sheet 33 and blanket 45 is placed over the upper surface 18 of the mattress with sheet 31 in contact with the mattress and zipper 32 zipped together. The pleats 34 and 35 of the sheet 33 are smoothed as are the pleats 46 and 47 of the blanket 45. The bedding is now completely made.

Figure 3:
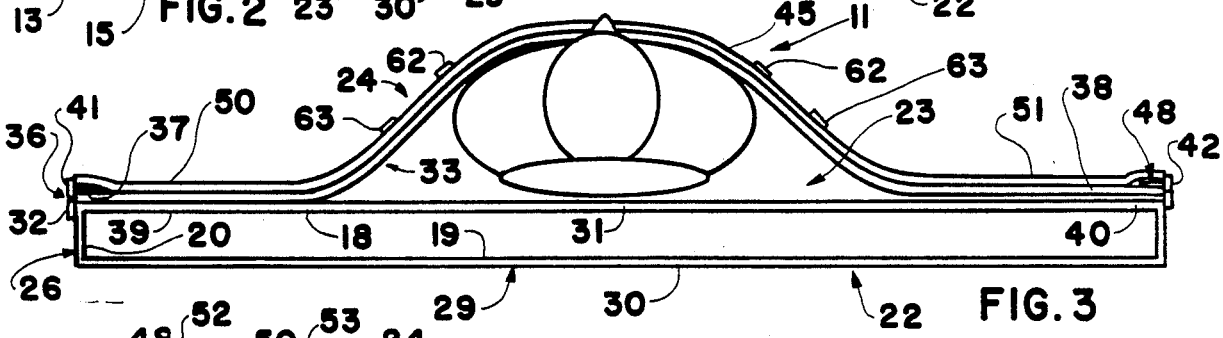
FIG. 3 is a sectional view of the bedding assembly shown in FIG. 2 with a person in the bed.
Figure 4:
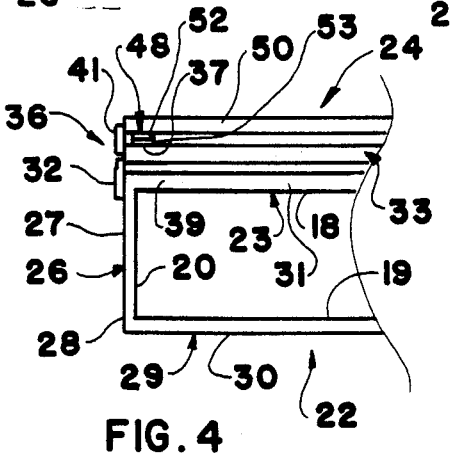
FIG. 4 is an enlarged fragmentary sectional view of the bedding assembly shown in FIG. 2.
Figure 5:
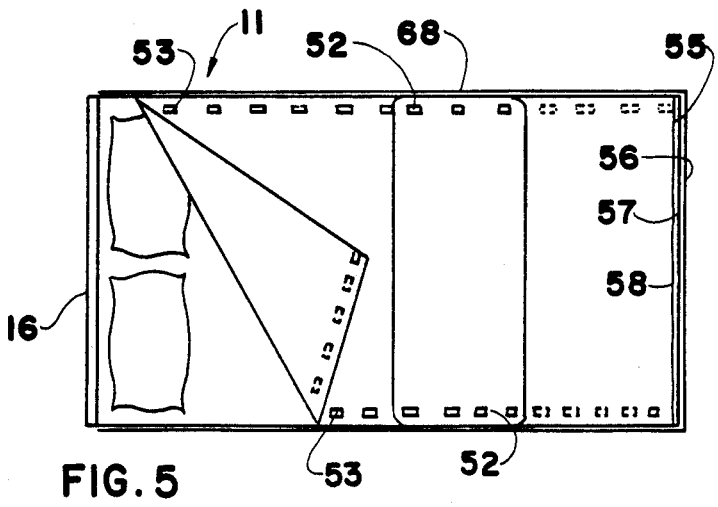
FIG. 5 is a top view of the bedding assembly of the invention shown in FIG. 1 with portions folded back.

To use the bed 12, a person simply unzips one of the side zippers 41 or 42 and slides his body between the sheet 31 and the sheet 33. The pleats 34, 35, 46 and 47 automatically open as shown in FIG. 3 allowing freedom for body movement. A person can turn and twist his body while sleeping without restriction from the bedding assembly. To leave the bed, the person simply unzips the side zipper 41 or 42 and slides out of bed.

In remaking the bedding assembly 11, all that has to be done is to rezip the zipper 41 or 42 and smooth the pleats 34, 35, 46 and 47. The task is completed easily and quickly even if the bed is large or in a confined area. To use the bed again, an individual simply unzips zipper 41 or 42 and slides into bed.

When the bedding assembly is to be changed for laundering, zipper 32 is opened around the edge of peripheral section 26 and the entire bedding assembly including bottom sheet 31, top sheet 33 and blanket 45 can be removed as a single unit. If desired, the skirt sections 65, 66 and 67 can be separated from the other sections prior to laundering by separating fasteners 68.

After laundering and drying, the bedding assembly 11 can be returned to the bed as quickly and easily as it was removed. Since the peripheral section 26 and sheet 30 already are in place, it only is necessary to align the sheet 31 with the peripheral section and zip the zipper 32 together again. Then, the pleats of the sheet 33 and the blanket 45 are smoothed and the operation is completed.

With the peripheral section 26 and the sheet 30 remaining in position continuously, the other portions of the bedding assembly always are aligned automatically. In addition, since there is no need to tuck any edges of sheets or blankets under the mattress, there is no reason to climb around the edge of the bed in making the bedding.

The only operation in the making of the bedding that requires any significant degree of attention and care is the original placement of the peripheral section 26 an the bottom connecting sheet section 30. Once this has been accomplished, the making of the bedding originally, daily or changing for laundering can be done quickly and easily in a few minutes or even seconds by any person with reasonable dexterity.

Even people with limited dexterity such as the elderly or the crippled can use the bedding assembly of the invention. Only a single part of the bedding assembly needs to be attended to at one time while the other parts remain anchored in place. Thus, individuals who cannot work with conventional bedding still can successfully use the bedding assembly of the invention.

The bedding assembly of the present invention can be employed on all types and sizes of beds which include some type of mattress or base. It is especially suitable for waterbeds, bunks, berths, adjustable hospital beds, folding beds as well as beds with conventional innerspring or foam mattresses.

It will be apparent that various modifications can be made in the particular bedding assembly described in detail above and shown in the drawings within the scope of the invention. The size, configuration and arrangement of components can be changed to meet specific requirements. Different fastening means can be utilized. Also, additional bedding components such as extra sheets, pads, blankets and/or quilts can be incorporated into the assembly. The number and arrangement of pleats can be different.

These and other changes can be made in the bedding assembly provided the functioning and operation thereof are not adversely affected. Therefore, the scope of the invention is to be limited only by the following claims.

What is claimed is:

1. A bedding assembly including a base encompassing portion, a base covering portion and a body covering portion; said base encompassing portion including a peripheral section around the periphery of a base including major top and bottom surfaces and sidewall sections joining said major surfaces, said peripheral section extending between the top and bottom surfaces of said base, said peripheral section including an upper edge adjacent said top surface and a lower edge adjacent said bottom surface, at least one connecting section extending over said bottom surface of said base and permanently joining opposite lower edges of said peripheral section; said base covering portion including first sheet means disposed over substantially the entire top surface of said base and in contact therewith, first fastening means releasably securing the edges of said first sheet means to the upper edges of said peripheral section along substantially the entire length thereof; said body covering portion including second sheet means disposed over said first sheet means and in contact therewith, said second sheet means including at least one pleat means, said pleat means extending substantially parallel to the longitudinal axis of said base intermediate and parallel to the edges thereof, second fastening means releasably securing the side edges of said second sheet means to adjacent edges of said first sheet means, blanket means disposed over said second sheet means and in contact therewith, said blanket means including at least one pleat means, said blanket pleat means being disposed substantially parallel to said second sheet pleat means, third fastening means releasably securing the side edges of said blanket means to adjacent edges of said second sheet means, fourth fastening means permanently affixing together the lower transverse edges of said first sheet means, said second sheet means and said blanket means, further including fifth fastening means disposed between the free ends of said pleat means of said second sheet means and the free ends of said pleat means of said blanket means; whereby said first fastening means may be operated without the necessity to operate either the second or third fastening means and the second fastening means may be operated without the necessity to operate either the first or third fastening means.

2. A bedding assembly according to claim 1 wherein said peripheral section includes a continuous section circumscribing the periphery of said base.

3. A bedding assembly according to claim 1 wherein said connecting section includes third sheet means substantially covering said bottom surface of said base.

4. A bedding assembly according to claim 1 wherein said first fastening means includes a zipper along substantially the entire length of said peripheral section.

5. A bedding assembly according to claim 1 wherein said second fastening means includes a pair of edge zippers.

6. A bedding assembly according to claim 1 wherein said second sheet means and said blanket means each include more than one pleat means.

7. A bedding assembly according to claim 6 wherein said pleat means are spaced from one another.

8. A bedding assembly according to claim 7 wherein said pleat means include a pair of spaced pleats reversed from one another.

9. A bedding assembly according to claim 1 including stripping disposed over said pleat means of said blanket means.

10. A bedding assembly according to claim 1 wherein said third fastening means includes spaced discrete elements including cooperating combinations of hooked fabric means and napped fabric means.

11. A bedding assembly according to claim 1 wherein said fourth fastening means includes stitching.

12. A bedding assembly according to claim 1 wherein said fifth fastening means including cooperating combinations of hooked fabric means and napped fabric means.

13. A bedding assembly according to claim 1 including skirt means extending from the side edges and the lower transverse edge of said blanket means.

14. A bedding assembly according to claim 13 including sixth fastening means releasably securing said skirt means to the edges of said blanket means.

* * * * *